US008979558B2

(12) United States Patent
Rubens

(10) Patent No.: US 8,979,558 B2
(45) Date of Patent: Mar. 17, 2015

(54) INTERPOSER ASSEMBLY

(71) Applicant: Paul Andrew Rubens, Allen, TX (US)

(72) Inventor: Paul Andrew Rubens, Allen, TX (US)

(73) Assignee: FCI Americas Technology LLC, Carson City, NV (US)

( * ) Notice: Subject to any disclaimer, the term of this patent is extended or adjusted under 35 U.S.C. 154(b) by 78 days.

(21) Appl. No.: 13/788,873

(22) Filed: Mar. 7, 2013

(65) Prior Publication Data

US 2013/0237092 A1 Sep. 12, 2013

Related U.S. Application Data

(60) Provisional application No. 61/609,775, filed on Mar. 12, 2012.

(51) Int. Cl.

| | |
|---|---|
| ***H01R 13/44*** | (2006.01) |
| ***H01R 31/06*** | (2006.01) |
| ***H01R 13/6581*** | (2011.01) |
| ***H01R 13/6596*** | (2011.01) |
| *H01R 12/53* | (2011.01) |
| *H01R 12/72* | (2011.01) |

(52) U.S. Cl.

CPC ..... *H01R 31/06* (2013.01); *H01R 13/6581* (2013.01); *H01R 13/6596* (2013.01); *H01R 12/53* (2013.01); *H01R 12/721* (2013.01)

USPC ..... 439/131

(58) Field of Classification Search

CPC ..... H01R 23/6873; H01R 4/64

USPC ..... 439/607.23–607.25, 92, 160, 152

See application file for complete search history.

(56) References Cited

U.S. PATENT DOCUMENTS

| | | | | |
|---|---|---|---|---|
| 6,443,768 | B1 * | 9/2002 | Dirkers et al. | 439/607.2 |
| 6,478,622 | B1 * | 11/2002 | Hwang | 439/607.2 |
| 6,749,448 | B2 * | 6/2004 | Bright et al. | 439/160 |
| 7,445,484 | B2 * | 11/2008 | Wu | 439/352 |
| 2013/0189876 | A1 * | 7/2013 | Lang et al. | 439/607.05 |

* cited by examiner

*Primary Examiner* — Tulsidas C Patel
*Assistant Examiner* — Phuongchi T Nguyen
(74) *Attorney, Agent, or Firm* — Baker & Hostetler LLP

(57) ABSTRACT

A shielded interposer assembly includes an electrically conductive plate, an electrically conductive EMI cage, and an interposer. The cage is configured to be supported by the electrically conductive plate and defines a cage interior. The interposer that defines first and second opposed mating interfaces. The interposer is configured to be supported by the electrically conductive plate such that each of the first and second mating interfaces is disposed in the cage interior. The EMI cage has front and rear ends that at least partially define front and rear mating paths that are configured to receive respective first and second electrical devices so as to mate the first and second electrical devices to the first and second mating ends, respectively, of the interposer.

16 Claims, 7 Drawing Sheets

INTERPOSER ASSEMBLY

CROSS-REFERENCE TO RELATED APPLICATIONS

This claims the benefit of U.S. Provisional Application Ser. No. 61/609,775, filed Mar. 12, 2012, the disclosure of which is hereby incorporated by reference as if set forth in its entirety herein.

BACKGROUND

In typical electrical devices that receive small form factor pluggable (SFP) or small form factor pluggable plus (SFP+) modules, such as telecommunications switching or routing devices, a plurality of electrical connectors configured to receive respective ones of the SFP modules are mounted to one or more printed circuit boards (PCBs). The PCBs are typically supported by the chassis of the electrical device. While the individual SFP modules can be inserted or removed from the chassis with little effort, the printed circuit board supporting the electrical connectors is often not removable without considerable effort, which can include taking the electrical device offline, disassembling the chassis, and so on. Accordingly, replacing the PCBs in such a device can be costly and time consuming. SFP+ modules are described in SFF-8431 Specification, enclosed at Exhibit 1 of U.S. Provisional Patent Application Ser. No. 61/609,775, and SFP modules are described in INF-8074i Specification, enclosed at Exhibit 2 of U.S. Provisional Patent Application Ser. No. 61,609,775, each of which is hereby incorporated by reference as if set forth in its entirety herein.

SUMMARY

In accordance with one embodiment, a shielded interposer assembly includes an electrically conductive plate. The shielded interposer assembly further includes an electrically conductive EMI cage that defines a front end and a rear end, and a cage interior that extends between the front and rear ends. The cage is configured to be supported by the electrically conductive plate. The shielded interposer assembly further includes an interposer that defines first and second opposed mating interfaces. The interposer is configured to be supported by the electrically conductive plate such that each of the first and second mating interfaces is disposed in the cage interior. Each of the front and rear ends of the cage at least partially define front and rear mating paths that are configured to receive respective first and second electrical devices so as to mate the first and second electrical devices to the first and second mating ends, respectively, of the interposer.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
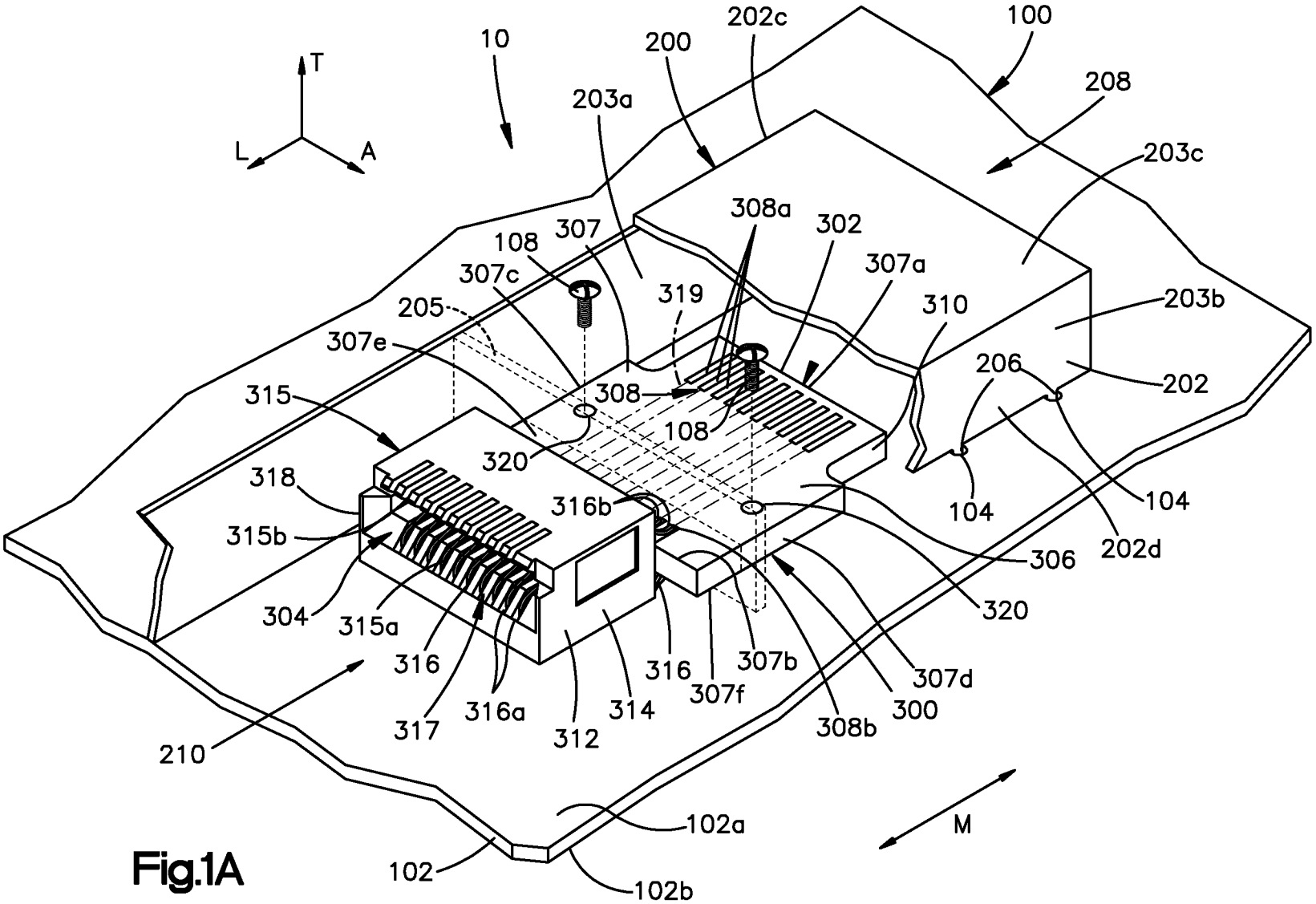
FIG. 1A is a perspective view of an interposer assembly that includes an electrically conductive plate, an interposer supported by the plate, an electrically conductive EMI cage supported by the plate and at least partially surrounding the interposer, showing a portion of the EMI cage removed to depict the interposer.
Figure 1B:
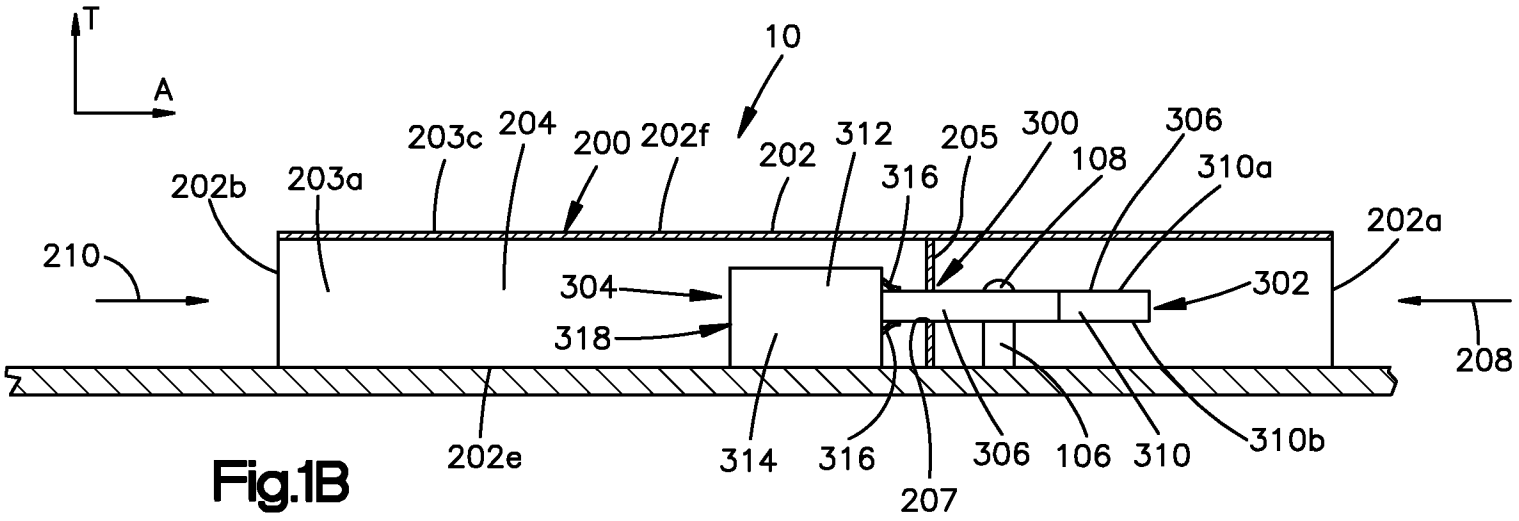
FIG. 1B is a sectional side elevation view of the interposer assembly illustrated in FIG. 1A.

Referring to FIGS. 1A-B, a shielded interposer assembly 10 constructed in accordance with one embodiment can include a plate, for instance an electrically conductive plate 100, an electrically conductive electromagnetic interference (EMI) cage 200 configured to be mounted to the electrically conductive plate 100, and an interposer 300 is configured to be at least partially disposed in the EMI cage 200 and supported by the electrically conductive plate 100. As described in more detail below, the interposer assembly 10 can be defined as part of an electrical assembly 20 that can include the interposer assembly 10 and respective first and second electrical devices 400 and 500 (see FIG. 3A) that are configured to be mated to the interposer 300 so as to be placed in electrical communication with the interposer 300, and therefore in electrical communication with each other via the interposer 300.

The EMI cage 200 includes a cage body 202 that can be made of any suitable material, for instance an electrically conductive material such as a metal. The cage body 202 can define a first or front end 202*a* and a second or rear end 202*b* that is spaced from the front end 202*a* along a first or longitudinal direction L. The cage body 202 can further define first and second sides 202*c* and 202*d* that are opposite each other and spaced from each other along a lateral direction A that extends substantially perpendicular to the longitudinal direction L. The cage body 202 can further define an inner or lower end 202*e*, and an outer or upper end 202*f* that is opposite the lower end 202*e* and spaced from the lower end 202*e* along a transverse direction T that extends substantially perpendicular to both the longitudinal direction L and the lateral direction A.

It should be appreciated for the purposes of illustration that the interposer assembly 10 is oriented such that the longitudinal direction L and the lateral direction A are oriented horizontally, and the transverse direction T is oriented vertically, though it should be appreciated that the orientation of the interposer assembly 10 can vary during use. Thus, as used herein, directional terms such as "down" and derivatives thereof can refer to a direction from the upper end 202*f* toward the lower end 202*e*, directional terms such as "up" and derivatives thereof can refer to a direction from the lower end 202*e* toward the upper end 202*f*, directional terms such as "forward" and derivatives thereof can refer to a direction from the rear end 202*b* toward the front end 202*a*, and directional terms such as "rearward" and derivatives thereof can refer to a direction from the front end 202*a* toward the rear end 202*b*.

The cage body 202 can define a rectangular shape as illustrated, or can define any suitable alternatively shape as desired. The cage body 202 can include a pair of first and second side walls 203*a* and 203*b*, respectively, that are disposed at the first and second sides 202*c* and 202*d* of the cage body 202, respectively. In accordance with the illustrated embodiment, each of the first and second side walls 203*a* and 203*b* can extend along a plane defined by the longitudinal direction L and the transverse direction T. Each of the first and second walls 203*a* and 203*b* can extend between the front and rear ends 202*a* and 202*b*, for instance from the front end 202*a* to the rear end 202*b*. Each of the first and second walls 203*a* and 203*b* can further extend between the lower and upper ends 202*e* and 202*f*, respectively, for instance from the lower end 202*e* to the upper end 202*f*. The cage body 202 can further include an upper wall 203*c*, disposed at the upper end 202*f* of the cage body 202. The upper wall 203*c* can extend between the front and rear ends 202*a* and 202*b*, respectively, for instance from the front end 202*a* to the rear end 202*b*. The upper wall 203*c* can further extend between the first and second side walls 203*a* and 203*b*, respectively, for instance from the first side wall 203*a* to the second side wall 203*b*.

The cage body 202 can include a EMI shielding wall 205 that, in the embodiment illustrated in FIG. 1B, can extend from the cage body 202 to the electrically conductive plate 100. For instance, the EMI shielding wall 205 can be disposed such that the interposer is disposed between the EMI shielding wall 205 and the second electrical device 500 when the second electrical device 500 is mated to the interposer 300. Thus, the EMI shielding wall 205 can be disposed forward of the mounting ends 316*b* of the interposer 300 (see FIG. 3C), and thus between the mounting ends 316*b* of the interposer, and the front end of a substrate, such as a printed circuit board 306, of the type described below, that is configured to mate with the first electrical device 400. The EMI shielding wall 205 can extend from the upper wall 203*c* to the electrically conductive plate 100, and can be disposed such that the first electrical device 400 is disposed between the EMI shielding wall 205 and the interposer 300 when the electrical assembly 20 is in its assembled configuration. The Emi shielding wall 205 is configured to absorb EMI radiation, thereby substantially preventing the EMI radiation that can be produced during operation of the electrical assembly 20 from leaking out the front end 202*a* of the cage body 202.

The printed circuit board 306 can extend through an opening 207 that extends through the EMI shielding wall 205. The EMI shielding wall 205 can be grounded to the printed circuit board 306 at one or more locations, for instance continuously at the interface between the EMI shielding wall 205 and the printed circuit board 306. For instance, the EMI shielding wall 205 can be conductive and in direct contact with the printed circuit board 306, or a gasket can ground the EMI shielding wall 205 to the printed circuit board 306. The first and second side walls 203*a* and 203*b* and the upper wall 203*c* can extend from the second end 202*b* to the EMI shielding wall 205, and can terminate at the EMI shielding wall 205, such that the EMI shielding wall 205 defines the front end 202*a* of the cage body 202. Alternatively, the first and second side walls 203*a* and 203*b* and the upper wall 203*c* can extend forward of the EMI shielding wall 205 so as to terminate at a location forward with respect to the EMI shielding wall 205 along the longitudinal direction L. For instance, the first and second side walls 203*a* and 203*b* and the upper wall 203*c* can terminate at a location such that the first electrical device 400 is disposed between the interposer 300 and the termination of the first and second side walls 203*a* and 203*b* and the upper wall 203*c* when the first electrical device is mated with the interposer 300.

The cage body 202, and thus the EMI cage 200, can define a cage interior 204 that can be a void that can be at least partially defined by the first and second side walls 203*a*, 203*b* and the upper wall 203*c* of the cage body 202, and the EMI shielding wall 205 of the cage body 202. Thus, the cage interior 204 in one embodiment can extend between the rear end 202*b* and the front end 202*a*, and thus the EMI shielding wall 205 when the EMI shielding wall 205 defines the front end 202*a*. For instance, the cage interior 204 can extend from the front end 202*a* (and thus the EMI shielding wall 205) to the rear end 202*b*. When the EMI shielding wall 205 is disposed between the front end 202*a* and the rear end 202*b*, the cage interior 204 can extend between the rear end 202*b* and the front end 202*a*, such that the EMI shielding wall 205 is disposed in the cage interior 204. The cage interior 204 can further extend between the first and second sides 202*c* and 202*d*, for instance from the first side 202*c* to the second side 202*d*. In this regard, it should be appreciated that the cage interior can extend between the first and second side walls 203*a* and 203*b*, for instance from the first side wall 203*a* to the second side wall 203*b*. The cage interior can further extend between the upper wall 203*c* and the lower end 202*e*. Thus, it can be said that the void that is defined by the cage interior 204 is at least partially enclosed by the first and second side walls 203*a* and 203*b* and the upper wall 203*c*. In accordance with the illustrated embodiment, the cage body 202, and thus the EMI cage 200, is at least partially open at both the front and rear ends 202*a* and 202*b*, such that complementary electrical devices can be inserted into or removed from the cage interior 204 substantially along a mating direction M that can be, for instance, the longitudinal direction L. The cage body 202, and thus the EMI cage 200, can further be at least partially open at the lower end 202*e*, for instance between the first and second side walls 203*a* and 203*b*, for example between the shielding wall 205 and the front end 202*a*. Accordingly, the electrically conductive plate 100 can at least partially or fully close the lower end 202*e* when the EMI cage 200 is mounted to the electrically conductive plate, as will now be described.

The EMI cage 200 can be configured to be supported by, for instance mounted to, the electrically conductive plate 100. For example, in accordance with the illustrated embodiment, the EMI cage 200 can include at least one mounting member such as a plurality of mounting members that are configured to attach to the electrically conductive plate 100 so as to mount the EMI cage to the electrically conductive plate 100. For instance, the mounting members can be configured as press-fit tails 206 that extend down from the cage body 202 substantially along the transverse direction T. In accordance with the illustrated embodiment, the press-fit tails 206 can extend from the first and second side walls 203*a* and 203*b*, for instance at the lower end 202*e*. The press-fit tails 206 can be configured to be inserted into respective apertures 104 of the electrically conductive plate 100 so as to mount the EMI cage to the electrically conductive plate 100. For instance, the press-fit tails 206 can be press-fit into the apertures such that the EMI cage 200 is retained in a mounted position with respect to the electrically conductive plate 100.

With continuing reference to FIGS. 1A-B, the electrically conductive plate 100 can define any suitable shape as desired. For instance, in accordance with the illustrated embodiment, the electrically conductive plate 100 includes a plate body 102 that can be constructed of any suitable material, for instance an electrically conductive material such as a metal. The plate body 102 can define a substantially sheet-like shape, such as that of a metal sheet, that extends along a plane defined by the longitudinal direction L and the lateral direction A. The plate body 102 constructed in accordance with one embodiment can define a first or upper surface 102*a* and second or lower surface 102*b* that is opposite the upper surface 102*a* and spaced from the upper surface 102*a* along the transverse direction T.

The upper surface 102*a* can be configured to support the EMI cage 200. For example, in accordance with the illustrated embodiment, the plate body 102 can define at least one mounting member such as a plurality of mounting members that are configured to engage the mounting members of the EMI cage 200 so as to support the EMI cage 200 relative to the electrically conductive plate 100 in the mounted position. For instance, the mounting members of the electrically conductive plate 100 can be configured as a plurality of apertures 104 that extend down into the upper surface 102*a* along the transverse direction T. The apertures 104 can further extend through the lower surface 102*b*, or can terminate between the upper surface 102*a* and the lower surface 102*b*. Each of the apertures 104 can be configured to receive a respective one of the press-fit tails 206 in press-fit engagement so as to retain the EMI cage 200 in the mounted position with respect to the electrically conductive plate 100. It should be appreciated that the interposer assembly 10 is not limited to the illustrated press-fit tails 206 and apertures 104, and that one or both of the electrically conductive plate 100 or the EMI cage 200 can be alternatively constructed such that the electrically conductive plate 100 supports the EMI cage 200 as desired.

The electrically conductive plate 100 can further be configured to support the interposer 300 and the EMI cage 200, such that the EMI cage 200 and the interposer 300 are both supported by the electrically conductive plate, such as the upper surface 102*a*, as described in more detail below. The electrically conductive plate 100 can be configured to be mounted to a chassis of an electrical device, such as a telecommunications switching device. For example, the electrically conductive plate 100 can be configured to be mounted to a mounting bracket that is supported by the electrical device. It should be appreciated that the electrically conductive plate 100 can comprise a lower wall of the cage body 202. For example, the electrically conductive plate 100 can be monolithic with the cage body 202, such that the electrically conductive plate 100 supports the cage body 202 and is monolithic with the cage body 202. Furthermore, it should be appreciated that the electrically conductive plate 100 can be defined by the chassis within which the interposer assembly 10 is installed.

When the EMI cage 200 is supported by the electrically conductive plate 100, the upper wall 203*c* can be spaced from the upper surface 102*a* of the plate body 102 such that the cage interior 204 extends along the transverse direction T between the electrically conductive plate 100 and the upper wall 203*c*, for instance from the electrically conductive plate 100 to the upper wall 203*c*. Accordingly, the upper wall 203*c* cooperates with the electrically conductive plate 100 so as to define the cage interior 204 of the cage body 202.

Figure 3A:
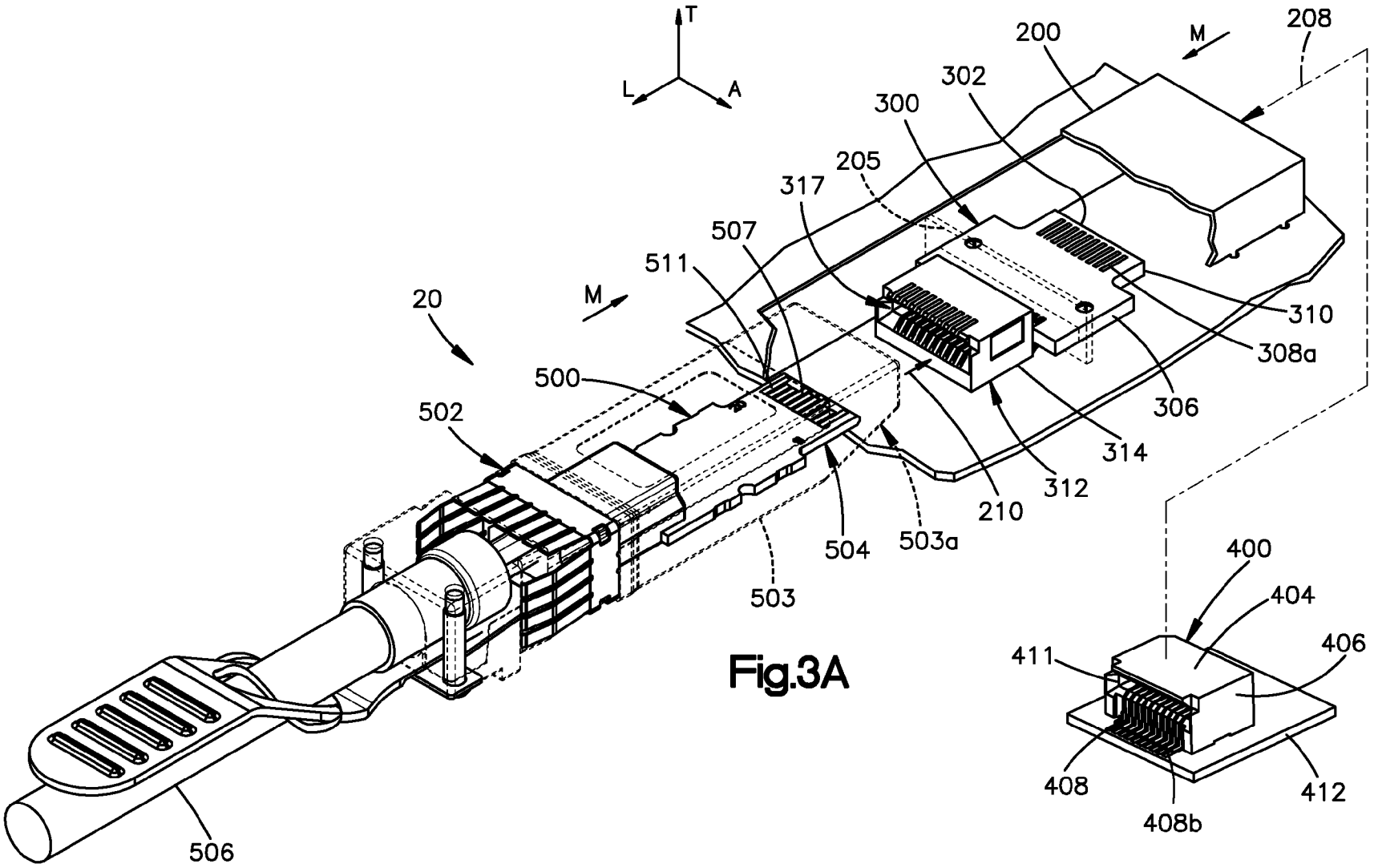
FIG. 3A is a perspective view of an electrical assembly including the interposer assembly illustrated in FIG. 1A, the first electrical device illustrated in FIG. 2A, and the second electrical device illustrated in FIG. 2B.

The front and rear ends 202*a* and 202*b* of the cage body 202 can at least partially define first and second mating paths, such as opposite front and rear mating paths 208 and 210, respectively, that are configured to receive the respective first electrical device 400 and the second electrical device 500, and to guide the respective first and second electrical devices 400 and 500 so as to mate the first and second electrical devices to different, for instance opposite, ends of the interposer 300 (see also FIG. 3A). For example, in accordance with the illustrated embodiment, the first and second side walls 203*a* and 203*b* and the upper wall 203*c* partially define the front and rear mating paths 208 and 210. The electrically conductive plate 100 can further define the front and rear mating paths 208 and 210, respectively. For example, the electrically conductive plate 100 can define a first portion of the upper surface 102*a* at the front end 202*a*, such that at least a portion of the first electrical device 400 is slidable or otherwise movable along a first or front mating path 208 in a respective mating direction through the front end 202*a* at a location above the first portion of the upper surface 102*a*, for instance along the first portion of the upper surface 102*a*, under the upper wall 203*c* (e.g., between the upper wall 203*c* and the electrically conductive plate 100), and between the first and second side walls 203*a* and 203*b* at the front end 202*a*. The electrically conductive plate 100 can define a second portion of the upper surface 102*a* at the rear end 202*b*, such that at least a portion of the second electrical device 500 is slidable or otherwise movable along a second or rear mating path 210 in a respective mating direction M through the rear end 202*b* at a location above the second portion of the upper surface 102*a*, for instance along the second portion of the upper surface 102*a*, under the upper wall 203*c* (e.g., between the upper wall 203*c* and the electrically conductive plate 100), and between the first and second side walls 203*a* and 203*b* at the front end 202*a*.

Thus, the interposer 300 can be configured to mate with each of the first and second electrical devices 400 and 500, respectively, so as to place the first and second electrical devices 400 and 500 in electrical communication with the interposer 300, and further to place the first and second electrical devices 400 and 500 in electrical communication with each other via the interposer 300. For example, in accordance with the illustrated embodiment, the interposer 300 defines a first mating interface 302 that is configured to mate with the first complementary electrical device 400, and an opposed second mating interface 304 that is spaced from the first mating interface 302 along the longitudinal direction L and is configured to mate with the second complementary electrical device 500.

The interposer 300 can be configured to be supported by the electrically conductive plate 100 such that the interposer 300 is at least partially disposed in the interior 204 of the EMI cage 200. For instance, each of the first and second mating interfaces 302 and 304 can be disposed in the cage interior 204, and thus between the front end 202*a* and the rear end 202*b* when both the EMI cage 200 and the interposer 300 are mounted to or otherwise supported by the electrically conductive plate 100. In this regard, it can be said that the cage body 202 can be constructed to at least partially surround the interposer 300, and that the cage interior 204 is sized to contain at least a portion up to all of the interposer 300, including the first and second mating interfaces 302 and 304. The interposer 300 can be disposed in the cage interior 204 at any desired location between the front and rear ends 202*a* and

202*b*, for example in accordance with particular types of the first and second electrical devices 400 and 500 that are mated to the interposer 300.

The first and second mating interfaces 302 and 304 can be configured to mate with any respective types of a respective first electrical device 400, such as a first electrical connector 404, and a second electrical device 500, such as a second electrical connector that can be configured as an optical transceiver module 502. It should be appreciated, of course, that the first mating interface 302 could alternatively be configured to mate with the second electrical device 500, such as the second electrical connector that can be configured as the optical transceiver module 502, and the second mating interface 304 could alternatively be configured to mate with the first electrical device 400, such as the first electrical connector 404. Thus, the interposer 300 places the first and second electrical devices 400 and 500 in electrical communication with each other when the interposer 300 is mated to the first and second electrical devices 400 and 500. It should be further appreciated that an electrical assembly 20 (see FIGS. 3A-C) can include the interposer assembly 10 and at least one or both of the first and second electrical devices 400 and 500.

In accordance with the illustrated embodiment, the first mating interface 302 can define a plug that can be configured as a substrate, such as a printed circuit board 306, configured to plug into a mating interface, such as a receptacle, of the complementary first electrical device 400 so as to place the interposer 300 in electrical communication with the first electrical device. The printed circuit board 306 can define a dielectric or electrically insulative substrate body 307 that defines a front end 307*a* and an opposed rear end 307*b* that is spaced from the front end 307*a* along the longitudinal direction L, opposed first and second sides 307*c* and 307*d* that are spaced from each other along the lateral direction A, an opposed upper and lower surfaces 307*e* and 307*f* that are spaced from each other along the transverse direction T. The printed circuit board 306 can include at least one such as a plurality of electrical conductors 319 in the form of electrically conductive traces that are supported by the substrate body 307, and respective contact pads 308 that are electrically and physically connected to the traces. For example, the illustrated printed circuit board 306 includes a mating end configured as a mating tab 310 that extends from the front end 307*a* of the substrate body 307. The mating tab 310 can be sized to be received in a receptacle 410 of the first electrical connector 404 (see FIG. 2A).

The mating tab 310 can support a first plurality 308*a* of the contact pads 308. For example, in accordance with the illustrated embodiment, the mating tab 310 defines opposed upper and lower tab surfaces 310*a* and 310*b*, and respective ones of the first plurality of contact pads 308*a* are affixed to respective ones of the upper and lower tab surfaces 310*a* and 310*b*. The printed circuit board can further include a second plurality 308*b* of contact pads 308 disposed proximate to the rear end 307*b* of the substrate body 307. Respective ones of the second plurality 308*b* of contact pads 308 can be spaced apart from each other along the lateral direction A and disposed on respective portions of the upper and lower surfaces 307*e* and 307*f* of the substrate body 307, respectively. Respective ones of the plurality of traces can be in electrical communication with respective ones of the first plurality 308*a* of contact pads 308 and respective ones of the second plurality 308*b* of contact pads 308, such that the electrical traces place the first mating interface 302 in electrical communication with the second mating interface 304.

The second mating interface 304 can define a receptacle that can be configured to receive a plug of the complementary second electrical device 500 so as to place the interposer 300 in electrical communication with the second electrical device 500. For instance, the second mating interface 304 of the interposer 300 can define a dielectric or electrically insulative interposer housing 314 and a plurality of electrical conductors 316 that are supported by the interposer housing 314. Each of the electrical conductors 316 can define a mating end 316*a* and an opposed mounting end 316*b*. The interposer housing 314 can define a receptacle 318 that houses at least a portion of the mating ends 316*a* and is configured to receive electrical conductors of the second electrical device 500. In accordance with the illustrated embodiment, the mating ends 316*a* terminate within the interposer housing 314, though they could alternatively extend out from the interposer housing 314 as desired.

The mating ends 316*a* of the electrical conductors 316 can be arranged in one or more rows 315 that are elongate along the lateral direction A. The electrical conductors 316 can define a gap 317 disposed a first or upper one of the rows 315*a* and a second or lower one of the rows 315*b* that is spaced from the upper row 315*a* along the transverse direction T. The gap 317 can be configured as a receptacle that is configured to receive electrical conductors 505 of the second electrical device 500. Thus, the mating ends 316*a* proximate to the second mating interface 304 can be configured as an edge card receptacle. The electrical conductors 316 whose mating ends 316*a* are disposed on the first or an upper one 315*a* of the rows 315 defines its mounting ends 316*b* spaced along the transverse direction T from the mounting ends 316*b* of the electrical conductors 316 whose mating ends 316*a* are disposed on the second or lower one 315*b* of the rows 315.

The gap 317 is sized to receive electrical conductors 505 of the second electrical device (see FIG. 2D) along the longitudinal direction L. The interposer housing 314 can be configured to support the plurality of the electrical conductors 316 such that the respective mating ends 316*a* of the plurality of the electrical conductors 316 are disposed proximate the second mating interface 304 of the interposer housing 314, such as in the interposer housing 314. The respective mounting ends 316*b* of the plurality of the electrical conductors 316 can be configured to straddle-mount onto the substrate body 307, for instance the rear end 307*b* of the substrate body 307, such that the mounting ends 316*b* of a first plurality of the electrical conductors 316 whose mating ends 316*a* are disposed on the upper row 315*a* are in contact with respective ones of the second plurality 308*b* of contact pads 308 on a first or upper surface 307*e* of the substrate body 307, and the mounting ends 316*b* of a second plurality of the electrical conductors 316 whose mating ends 316*a* are disposed on the lower row 315*b* are in contact with respective ones of the second plurality 308*b* of contact pads 308 on the second or lower surface 307*f* of the substrate body 307 that is opposite the upper surface 307*e* (see FIG. 3C). Accordingly, the electrical conductors 316 of the second mating interface 304 are placed in electrical communication with the electrical conductors of the printed circuit board 306.

It should be appreciated that the electrical conductors 316 of the second mating interface 304 can be placed in electrical communication with the printed circuit board 306 in any suitable alternative manner as desired. For instance, the interposer housing 314 can receive the printed circuit board 306 so as to place the electrical conductors 316 in electrical communication with the printed circuit board 306. Alternatively still, the electrical conductors 316 can be electrically connected to a flex cable, or can define a flex cable, that is electrically connected to the printed circuit board 306. In this regard, it should be appreciated that the interposer 300 can include an electrical connector 312, which can be configured as a straddle mount connector, that includes the interposer housing 314 and the electrical conductors 316 that are supported by the interposer housing 314, and the interposer 300 can further include the printed circuit board 306 that is electrically connected to the electrical conductors 316 of the electrical connector 312 in any manner as desired.

It should further be appreciated that the interposer 300 can define first and plugs or receptacles at the first and second mating interfaces 302 and 304, respectively. For instance, the interposer can define plugs at each of first and second mating interfaces, or can define receptacles at each of the first and second mating interfaces 302 and 304, or can define a plug at one of the first and second mating interfaces 302 and 304, and a receptacle at the other of the first and second mating interfaces 302. While the plug has been described above in accordance with the printed circuit board 306, it is recognized that suitable alternative plugs can also be constructed from individual electrical conductors that are supported by a dielectric housing. Furthermore, while the receptacle has been described in accordance with the electrical connector 312, it should be appreciated that suitable alternative receptacles can be constructed as desired, such that the first and second mating interfaces 302 and 304 are in electrical communication with each other, and are configured to be placed in electrical communication with complementary first and second electrical devices, whose mating ends can be configured as plugs or receptacles so as to mate with the first and second mating ends 302 and 304.

Figure 2A:
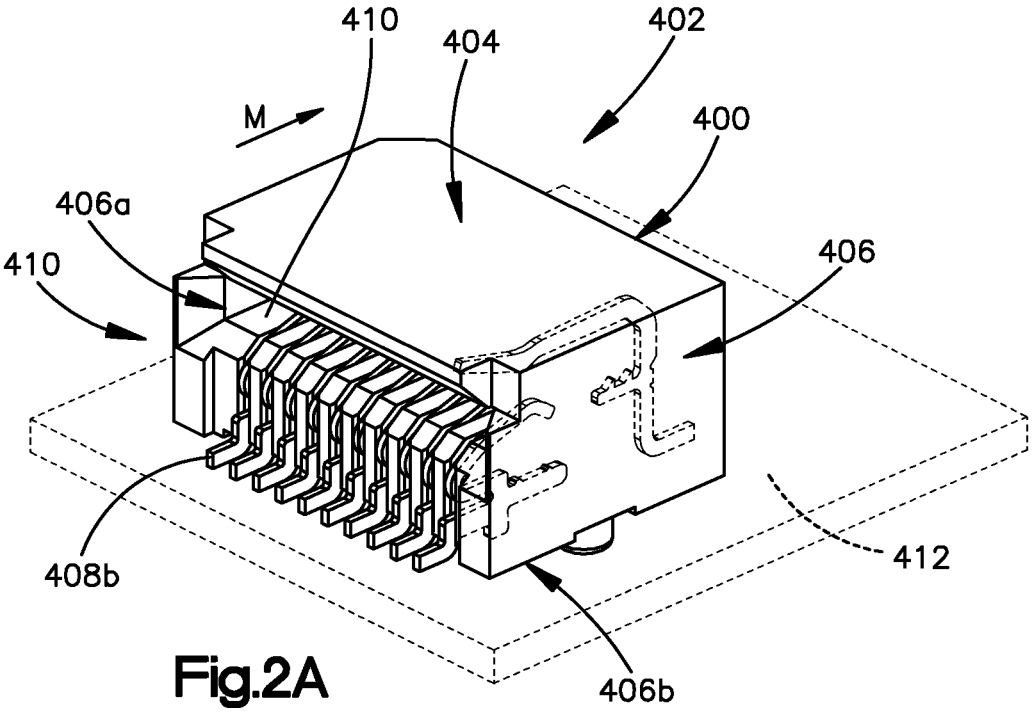
FIG. 2A is a perspective view of a first electrical device mounted to a substrate, the first electrical device configured to be mated to the interposer so as to place the second electrical device in electrical communication with the interposer
Figure 2B:
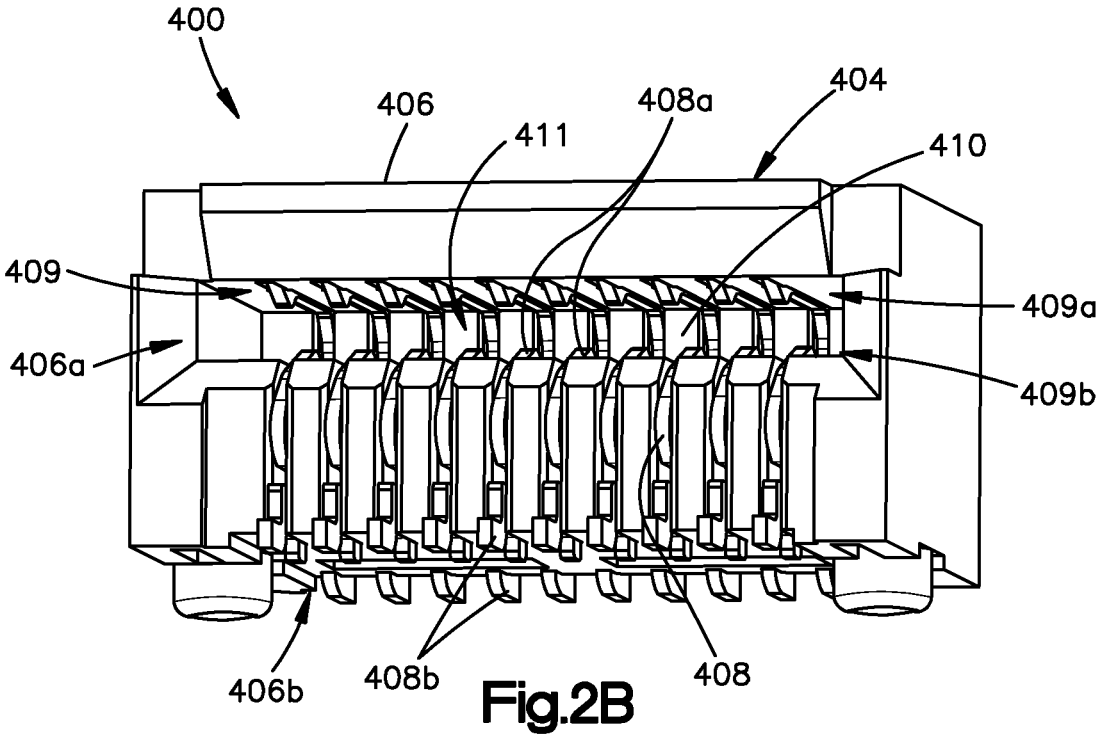
FIG. 2B is an enlarged perspective view of the first electrical device illustrated in FIG. 2A, showing a mating end of the first electrical device that is configured to mate to the interposer.
Figure 2C:
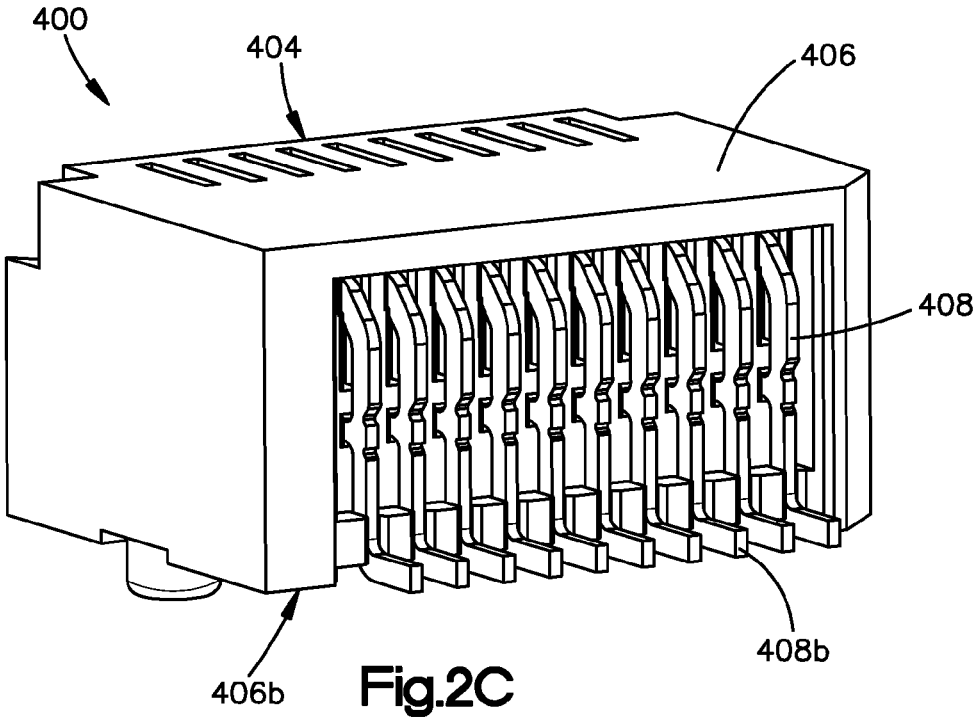
FIG. 2C is an enlarged perspective view of the first electrical device illustrated in FIG. 2B, showing a mounting end of the first electrical device that is configured to mount to the substrate so as to place the first electrical device in electrical communication with the substrate.

Referring now to FIGS. 2A-C, the first electrical device 400 can be a first electrical connector 404, which can be configured as a small form factor pluggable (SFP) or small form factor pluggable plus (SFP+) electrical connector, or any suitable electrical connector configured to mate with the interposer 300 so as to be placed in electrical communication with any suitable embodiment of the second electrical device 500. The electrical connector 402 can include a dielectric or electrically insulative connector housing 406 and a plurality of electrical conductors 408 that are supported by the connector housing 406. The electrical conductors 408 can be configured as receptacle contacts that are configured to receive complementary electrical conductors of a complementary device, such as the interposer 300, so as to mate the first electrical connector 402 to the interposer 300. The connector housing 406 defines a mating interface 406*a* that can be configured as a receptacle 410 that extends into the connector housing 406 along the longitudinal direction L.

The connector housing 406 can be configured to support the plurality of electrical conductors 408 such that respective mating ends 408*a* of the electrical conductors 408 are disposed proximate the receptacle 410, such as in the receptacle 410. The first mating interface 302 of the interposer 300, which can be constructed as the printed circuit board 306 as described above, is configured to plug into the receptacle 410 of the first electrical connector 404 such that the first plurality of contact pads 308*a* contact the mating ends 408*a* of the electrical conductors 408 so as to place the printed circuit board 306, and thus the electrical conductors 316 at the second mating interface 304, in electrical communication with each other.

The connector housing 406 further defines a mounting interface 406*b*, and each of the electrical conductors 408 can define respective mounting ends 408*b* that are disposed proximate to the mounting interface 406*b* and are configured to be mounted to a substrate such as a printed circuit board 412 that is configured to support the first electrical connector 404. In this regard, an electrical assembly 402 can include the first electrical connector 404 and the printed circuit board 412 to which the first electrical connector 404 is configured to be mounted, or to which the first electrical connector 404 is mounted. The mating interface 406*a* can be oriented substantially perpendicular to the mounting interface 406*b*, such that the first electrical connector 404 is referred to as a right-angle electrical connector. Alternatively, the first electrical connector 404 can be configured as a vertical electrical connector whereby the mating interface 406*a* is oriented substantially parallel to the mounting interface 406*b*. The mating ends 408*a* of the electrical conductors 408 can be arranged in one or more rows 409 that are elongate along the lateral direction A. The electrical conductors 408 define a gap 411 disposed a first or upper one of the rows 409*a* and a second or lower one of the rows 409*b* that is spaced from the upper row 409*a* along the transverse direction T. The mating tab 310 is configured to be received by the gap such that the rows 409*a* and 409*b* of mating ends 408*a* straddle the mating tab 310 and are placed in electrical communication with the first plurality of contact pads 308*a*.

The electrical conductors 408 whose mating ends 408*a* are elongate along a first or an upper one of the rows 409*a* defines its mounting ends 408*b* proximate to one of the front end or the rear end of the connector housing 406, while the electrical conductors 408 whose mating ends 408*a* are elongate along a second or a lower one of the rows 409*b* defines its mounting ends 408*b* proximate to other of the front end or the rear end of the connector housing 406. In accordance with the illustrated embodiment, the mounting ends 408*b* of the electrical conductors 408 of the upper row 409*a* are disposed proximate to the rear end of the connector housing, and the mounting ends 408*b* of the electrical conductors 408 of the lower row 409*b* are disposed proximate to the front end of the connector housing. The mating interface 406*a* can be disposed at, for instance defined by, the front end of the connector housing 406, and the rear end is disposed opposite the front end. The first electrical connector 404 can be mounted to the printed circuit board 412 such that the respective mounting ends of the plurality of electrical conductors 408 are placed in electrical communication with electrical conductors, such as electrical traces, that are carried by the printed circuit board 412. Accordingly, the printed circuit board 412 is placed in electrical communication with the electrical conductors 316 of the interposer 300 when the electrical assembly 402 is mated with the first mating interface 302 of the interposer 300.

Figure 3B:
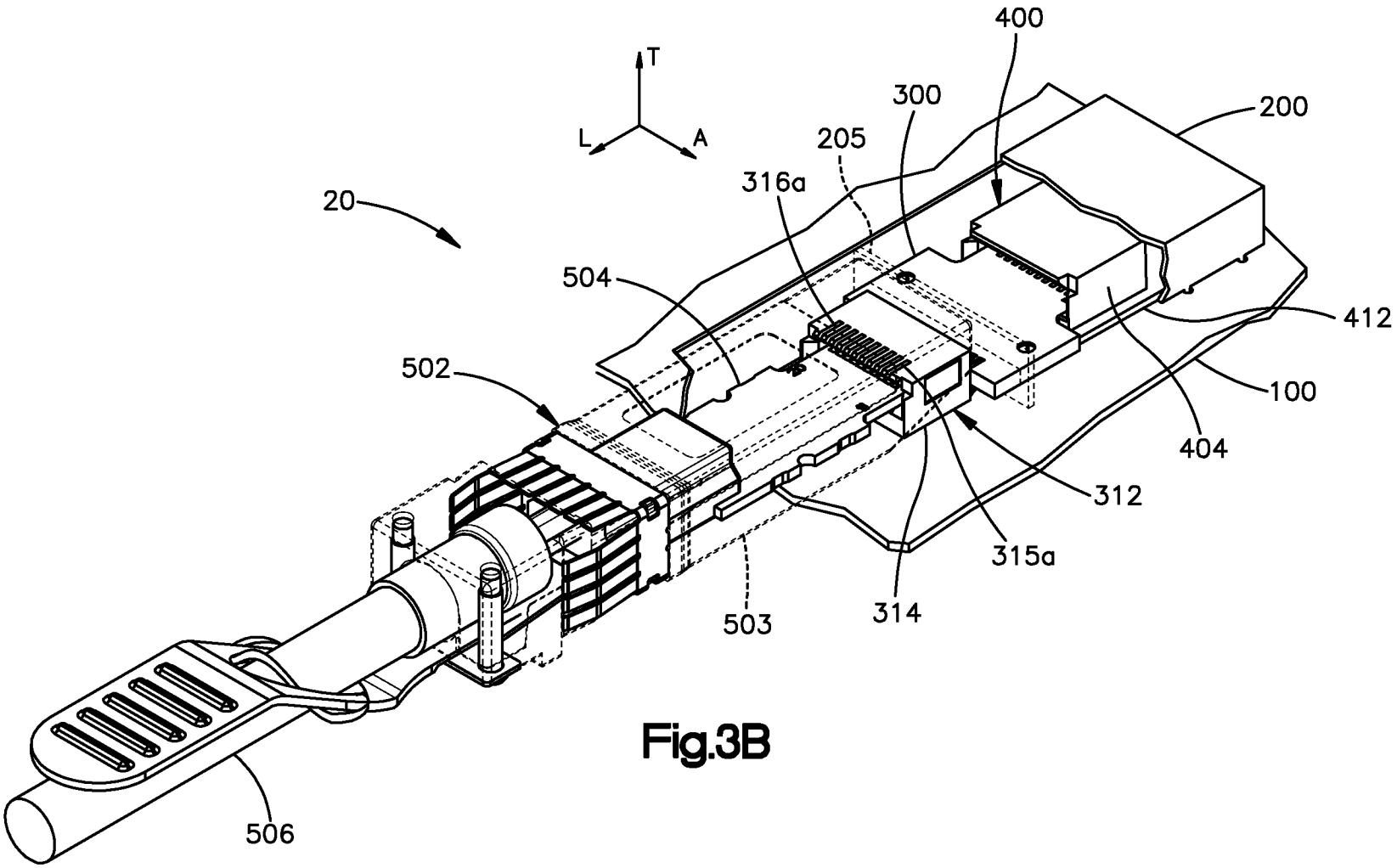
FIG. 3B is a perspective view of the electrical assembly illustrated in FIG. 3A showing the first and second electrical devices electrically mated to the interposer.
Figure 3C:
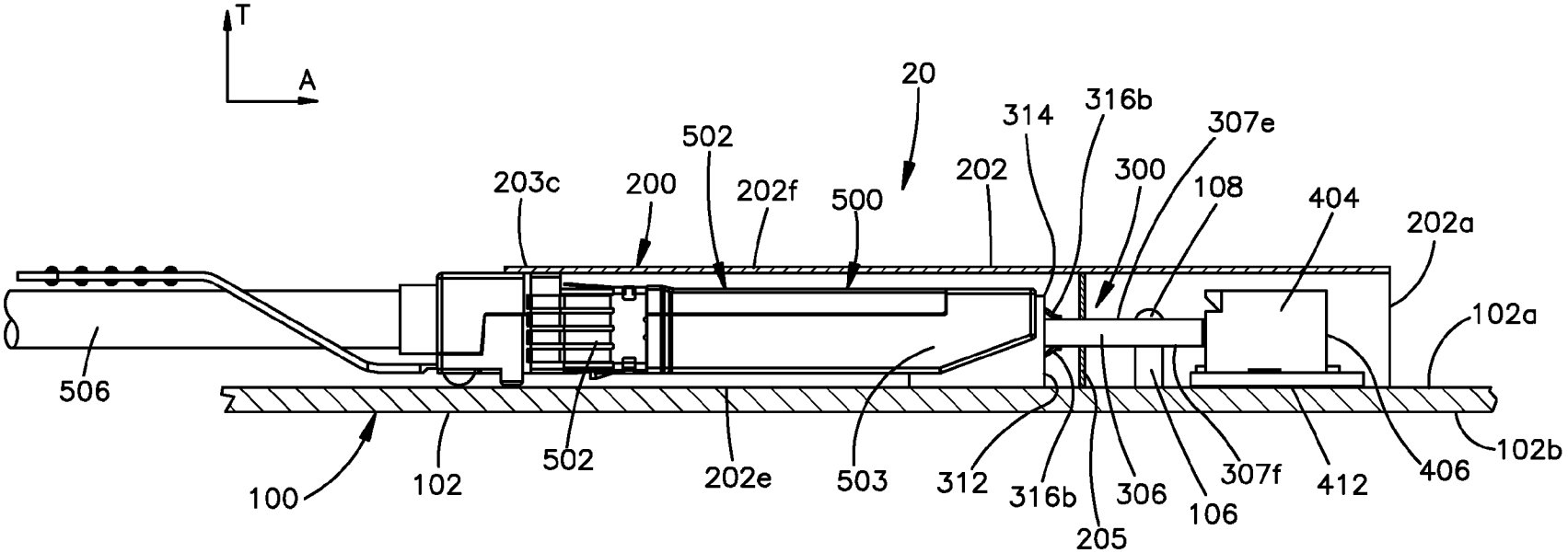
FIG. 3C is a sectional side elevation view of the electrical assembly illustrated in FIG. 3B.

As illustrated in FIGS. 3A-C, the first mating interface 302 of the interposer 300 is configured to be received in the gap 411 so as to mate the mating ends 408*a* of the electrical conductors 408 with the first plurality of contact pads 308*a* of the printed circuit board 306. In particular, the first electrical connector 404 can be mated to the first mating interface 302 of the interposer 300 by inserting the electrical assembly 402 into the front end 202*a* of the cage body 202 along the front mating path 208 and sliding the electrical assembly 402 forward in the mating direction M, which can be defined by the longitudinal direction L, along the upper surface 102*a* of the plate body 102 until the mating tab 310 is received in the receptacle 410 of the first electrical connector 404, and in the gap 411, such that the respective mating ends 408*a* of the plurality of electrical conductors 408 are brought into contact with respective ones of the plurality of contact pads 308. The printed circuit board 412 of the electrical assembly 402 can be supported by, for instance can rest on, the upper surface 102*a* of the plate body 102 of the electrically conductive plate 100. It should be appreciated that the electrical conductors 408 can be referred to as receptacle contacts that receive the first mating interface 302 of the interposer 300. The electrical assembly 402 can be unmated from the first mating interface 302 by causing the first electrical connector 404 to disengage from the first mating interface 302, for example by pulling the electrical assembly 402 backward along a direction opposite the mating direction M and away from the first mating interface 302, thereby removing the mating tab 310 from the gap 411.

Figure 2D:
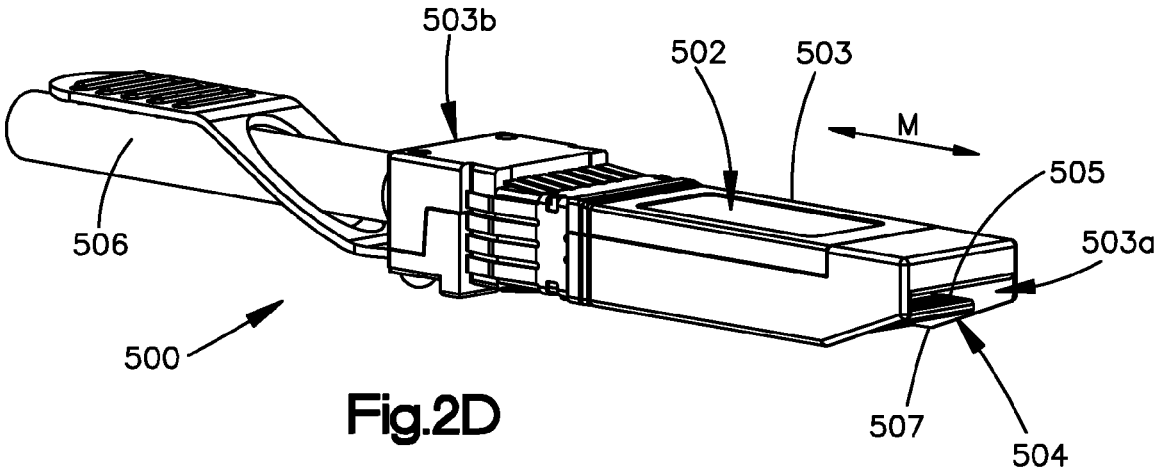
FIG. 2D is a perspective view of a second electrical device configured to be mated to the interposer so as to place the second electrical device in electrical communication with the interposer, and further in electrical communication with the first electrical device when the first electrical device is mated with the interposer

Referring now to FIG. 2D, the second electrical device 500 can be configured as a second electrical connector, such as an SFP or SFP+ optical transceiver module 502, or any suitable alternative device, such as a QSFP+, CXP, mini-SAS module including a mini-SAS connector and cables. The optical transceiver module 502 can include a dielectric or electrically insulative transceiver housing 503 that defines mating interface 503*a* and a mounting interface 503*b*. The optical transceiver module 502 further includes a plurality of electrical conductors 505 that are supported by the transceiver housing 503, for instance at the mating interface 503*a*. In accordance with the illustrated embodiment, the optical transceiver module 502 can include a printed circuit board 504 that is supported by the transceiver housing 503. The printed circuit board 504 can include a dielectric or electrically insulative substrate body 507 and at least one such as a plurality of electrical conductors in the form of electrically conductive traces that are supported by the substrate body 507. The optical transceiver module 502 can further include at least one cable 506, such as an optical cable, that is supported by the transceiver housing 503, for instance at the mounting interface 503*b*. The optical transceiver module 502 can thus be referred to as a standard SFP or SFP+ cable head. For instance, the cable 506 can extend through the transceiver housing 503 at the mounting interface 503*b*, and can be electrically connected to the electrical conductors 505 in the transceiver housing 503.

The printed circuit board 504 can define a mating end that is configured as a plug so as to be received in the receptacle defined by the gap 317 defined between the upper and lower rows 315*a-b* of electrical conductors 316 of the second mating interface 304 of the interposer 300 (see FIG. 1A). Accordingly, contact pads 511 (see FIG. 3A) of the printed circuit board 504 that are disposed on an upper surface of the substrate body 507, and are in electrical communication with respective ones of the electrical traces carried by the substrate body 507, can contact the mating ends 316*a* of the upper row 315*a* when the printed circuit board 504 is received by the gap 317. Similarly, contact pads of the printed circuit board 504 that are disposed on an lower surface of the substrate body 507, and are in electrical communication with respective ones of the electrical traces carried by the substrate body 507, can contact the mating ends 316*a* of the lower row 315*b* when the printed circuit board 504 is received by the gap 317. The mating interface 503*a* of the transceiver housing 503 can be configured to receive at least a portion of the interposer housing 314 as the gap receives the printed circuit board 504.

Referring now to FIGS. 3A-C, the second electrical device, such as the optical transceiver module 502, can be mated to the interposer 300 at the second mating interface 304 by inserting the optical transceiver module 502 into the rear end 202*b* of the cage body 202 along the rear mating path 210 and sliding the optical transceiver module 502 rearward in the respective mating direction M along the upper surface 102*a* of the plate body 102 until the gap 317 defined by the mating ends 316*a* receives the mating end of the optical transceiver module 502, which can be defined by the printed circuit board 504 as described above, such that the electrical conductors 505 are placed in contact, and thus electrical communication, with the mating ends 316*a* of the electrical conductors 316 of the interposer. The optical transceiver module 502 can be unmated from the second mating interface 304 by causing the mating end, for instance defined by the printed circuit board 504, to disengage from the second mating interface 304, for example by pulling the optical transceiver module 502 forward along the longitudinal direction L, away from the second mating interface 304. In this regard, the second mating interface 304 can be configured as an edge card receptacle as described above. It should be appreciated, however, that the second mating interface 304 can be alternatively constructed as desired. For instance, the second mating interface 304 can be define a receptacle constructed in any manner as desired so as to receive, and thus electrically connect to, a complementary plug mating end 504 of the optical transceiver module 502. The second mating interface 304 can be configured as the SFP or SFP+ electrical connector 312, or any suitable device whose connection is made via a card edge connector, such as the electrical connector 312, and a printed circuit board, such as the printed circuit board 306, as described herein.

When the first electrical device 400 is mated with the interposer 300 at the first mating interface 302, and the second electrical device 500 is mated with the interposer 300 at the second mating interface 304, the electrical conductors 316 and 319 of the interposer 300 place the electrical conductors 408 of the first electrical device, and thus also the electrical traces of the printed circuit board 412, in electrical communication with the electrical conductors 505 of the second electrical device 500, and thus also the optical cable 506. While the interposer 300 can include the electrical connector 312 mounted onto the printed circuit board 306 so as to define two sets of electrical conductors 316 and 319 that are placed in electrical communication, it should be appreciated that the interposer 300 can define one set of electrical conductors that extend from the first mating interface 302 to the second mating interface 304. For instance, the interposer housing 314 can define the first mating interface 302, such that the electrical conductors 316 extend from the first mating interface 302 to the second mating interface 304. Thus, it can be said that the interposer 300 includes at least one electrical conductor, such as at least one plurality of electrical conductors, that extend between the first and second mating interfaces 302 and 304, for instance from the first mating interface 302 to the second mating interface 304. The at least one plurality of electrical conductors can include one plurality of electrical conductors, such as the electrical conductors 316, alone or in combination with a second plurality of electrical conductors, such as the electrical conductors 319.

In accordance with the illustrated embodiment, it can be said that the interposer 300 is an optical transceiver interposer that comprises the straddle mount electrical connector 312 comprising a straddle-mount end configured to mount onto the printed circuit board 306, and a receptacle end that is configured to receive the electrical conductors 505 of the second electrical device 500, and that the optical transceiver interposer 300 further comprises a substrate, such as the printed circuit board 306, mounted to the straddle-mount end of the straddle-mount electrical connector 312. Furthermore, the substrate, such as the printed circuit board 306, can be sized and shaped to mate operationally with a standard SFP or SFP+ board mounted receptacle connector, such as the first electrical device 400, and the receptacle end, defined by the second mating interface 304, is sized and shaped to mate operationally with a standard SFP or SFP+ optical transceiver plug connector, such as the optical transceiver module 502. Moreover, because the first and second mating interfaces 302 and 304 extend substantially parallel to each other along the longitudinal direction L and mate with the complementary first and second electrical devices 400 and 500, respectively, along the longitudinal direction L, it can be said that the illustrated interposer 300 is a vertical interposer. However it should be appreciated that the interposer can alternatively be configured as a right-angle interposer, wherein the first and second mating interfaces 302 and 304 extend substantially perpendicular to each other, and receive the complementary first and second electrical devices 400 and 500, respectively, along directions that are perpendicular to each other.

The electrically conductive plate 100 can be configured to support the interposer 300. For example, the electrically conductive plate 100 can further include mounting hardware that is configured to retain the interposer 300 in a mounted position relative to the electrically conductive plate. The mounting hardware can be attached to the electrically conductive plate 100. In accordance with the illustrated embodiment, the mounting hardware of the electrically conductive plate 100 can include at least one such as a pair of standoffs 106 defining threaded interiors, and a corresponding at least one such as a pair of screws 108 that are configured to be driven into the standoffs 106. The printed circuit board 306 can define at least one such as a pair of mounting holes 320 that extend through the substrate body 307 substantially along the transverse direction T. The mounting holes 320 can be aligned with respective ones of the standoffs 106 such that the printed lower surface 307*f* of the substrate body 307 can be abutted against the standoffs 106 and each of the screws 108 can be disposed in a respective one of the mounting holes 320 and driven into a respective one of the standoffs 106. The screws 108 can be tightened within the respective standoffs 106 in order to secure the interposer 300 in a mounted position relative to the electrically conductive plate 100. Each standoff 106 can be constructed to define a height along the transverse direction T such that the printed circuit board 306 is spaced above the electrically conductive plate 100 when the printed circuit board 306 is mounted to the electrically conductive plate 100.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. A shielded interposer assembly comprising:

an electrically conductive EMI cage that defines a front end and a rear end, and a cage interior that extends between the front and rear ends, the cage configured to be supported by an electrically conductive plate;

an interposer that defines a first mating interface and a second mating interface opposite the first mating interface, and at least one plurality of electrical conductors that extends from the first mating interface to the second mating interface, the interposer configured to be supported by the electrically conductive plate such that each of the first and second mating interfaces are disposed in the cage interior;

wherein each of the front and rear ends of the cage at least partially define front and rear mating paths that are configured to receive respective first and second electrical devices so as to electrically mate the first and second electrical devices to the first and second mating ends, respectively, of the interposer.

2. The shielded interposer assembly as recited in claim 1, wherein the cage includes a pair of upstanding side walls that extend between the front end and the rear end, and an upper wall that is connected between the side walls and extends between the front end and the rear end, wherein the upper wall is spaced from the electrically conductive plate when the cage is supported by the electrically conductive plate such that the cage interior extends between the electrically conductive plate and the upper wall.

3. The shielded interposer assembly as recited in claim 1, wherein the electrically conductive plate defines a first surface and an opposed second surface, and the cage and the interposer are both supported by the first surface.

4. The shielded interposer assembly as recited in claim 1, further comprising the electrically conductive plate.

5. The shielded interposer assembly as recited in claim 4, wherein the electrically conductive plate further defines the front mating path.

6. The shielded interposer assembly as recited in claim 5, wherein the electrically conductive plate further defines the rear mating path.

7. The shielded interposer assembly as recited in claim 1, wherein the plate comprises sheet metal.

8. The shielded interposer assembly as recited in claim 7, wherein the second mating interface is configured as a receptacle configured to receive a complementary plug of the second electrical device.

9. The shielded interposer assembly as recited in claim 8, wherein the second mating interface comprises an edge card receptacle.

10. The shielded interposer assembly as recited in claim 9, wherein the first mating interface comprises a circuit board having electrical traces that are in electrical communication with the second mating interface.

11. The shielded interposer assembly as recited in claim 1, wherein the first mating interface is configured to plug into a complementary receptacle of the first electrical device.

12. The shielded interposer assembly as recited in claim 11, wherein the first mating interface comprises a circuit board having electrical traces that are in electrical communication with the second mating interface.

13. The shielded interposer assembly as recited in claim 12, wherein the circuit board defines at least one mounting hole configured to receive hardware that is attached to the electrically conductive plate so as to mount the circuit board to the electrically conductive plate.

14. The shielded interposer assembly as recited in claim 13, wherein the circuit board is spaced above the electrically conductive plate when the circuit board is mounted to the electrically conductive plate.

15. An EMI cage configured to at least partially surround an interposer that is configured to mate with an electrical connector at a first mating end, and an optical transceiver at an opposed second mating end, the electrically conductive EMI cage comprising:

an electrically conductive cage body that defines a first end and an opposed second end, the cage body including a pair of upstanding side walls that extend between the front end and the rear end, and an upper wall that is connected between the side walls and extends between the front end and the rear end, wherein the side walls and the upper wall at least partially define a cage body interior sized to contain the interposer, and the first and second mating interfaces, and the first and second ends are open so as to at least partially define respective first and second mating paths for the electrical connector and the optical transceiver to mate with the respective first and second mating ends of the interposer;

wherein the cage body is configured to be supported by an electrically conductive plate, such that the upper wall cooperates with the electrically conductive plate so as to define the cage body interior.

16. An electrical assembly comprising:

an electrical connector;

an optical transceiver;

an interposer that defines a first mating interface configured to electrically connect with the electrical connector, and a second mating interface configured to electrically connect with the optical transceiver;

an EMI cage that includes an electrically conductive cage body that defines a first end and an opposed second end, the cage body including a pair of upstanding side walls that extend between the front end and the rear end, and an upper wall that is connected between the side walls and extends between the front end and the rear end, wherein the side walls and the upper wall at least partially define a cage body interior sized to contain both the first and second mating interfaces of the interposer, and the first and second ends are open so as to at least partially define respective first and second mating paths for the electrical connector and the optical transceiver to mate with the respective first and second mating ends of the interposer;

an electrically conductive plate, wherein the interposer and the EMI cage are configured to be mounted on the electrically conductive plate.

* * * * *